US009453271B2

(12) United States Patent
Carpenter et al.

(10) Patent No.: US 9,453,271 B2
(45) Date of Patent: Sep. 27, 2016

(54) CEMENTED CARBIDE

(75) Inventors: Michael Carpenter, Warwickshire (GB); Jane Smith, Conventry (GB)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 318 days.

(21) Appl. No.: 13/876,171

(22) PCT Filed: Oct. 6, 2011

(86) PCT No.: PCT/EP2011/067465

§ 371 (c)(1), (2), (4) Date: Mar. 27, 2013

(87) PCT Pub. No.: WO2012/045815

PCT Pub. Date: Apr. 12, 2012

(65) Prior Publication Data

US 2013/0199411 A1 Aug. 8, 2013

Related U.S. Application Data

(60) Provisional application No. 61/406,391, filed on Oct. 25, 2010.

(30) Foreign Application Priority Data

Oct. 8, 2010 (EP) ..... 10187029

(51) Int. Cl.

| | |
|---|---|
| ***C22C 29/08*** | (2006.01) |
| ***C22C 19/05*** | (2006.01) |
| ***C22C 29/06*** | (2006.01) |

(52) U.S. Cl.

CPC ..... *C22C 29/08* (2013.01); *C22C 19/055* (2013.01); *C22C 29/067* (2013.01)

(58) Field of Classification Search

None

See application file for complete search history.

(56) References Cited

U.S. PATENT DOCUMENTS

| | | | | |
|---|---|---|---|---|
| 4,497,660 | A | 2/1985 | Lindholm | |
| 5,880,382 | A * | 3/1999 | Fang et al. | 75/236 |
| 6,524,364 | B1 | 2/2003 | Ederyd | |

FOREIGN PATENT DOCUMENTS

| | | | |
|---|---|---|---|
| EP | 1413637 | A1 | 4/2004 |
| EP | 2199418 | A2 | 6/2010 |
| JP | 562235457 | A | 10/1987 |
| JP | 2001515961 | A | 9/2001 |
| JP | 200491838 | A | 3/2004 |
| JP | 2004211172 | A | 7/2004 |
| JP | 2009542916 | A | 12/2009 |
| JP | 2010514933 | A | 5/2010 |

* cited by examiner

*Primary Examiner* — Colin W Slifka

(74) *Attorney, Agent, or Firm* — Corinne R. Gorski

(57) ABSTRACT

The present invention relates to a cemented carbide for oil and gas applications comprising a hard phase comprising WC and a binder phase wherein the cemented carbide composition comprises WC and, in wt-%, 3-11 Ni, 0.5-7 Cr, 0.3-1.5 Mo, 0-1 Nb, and 0-0.2 Co, and a method of making thereof.

12 Claims, No Drawings

CEMENTED CARBIDE

RELATED APPLICATION DATA

This application is a §371 National Stage Application of PCT International Application No. PCT/EP2011/067465 filed Oct. 6, 2011 claiming priority of European Application No. 10187029.3, filed Oct. 8, 2010 and U.S. Application No. 61/406,391 filed on Oct. 25, 2010.

The present invention relates to a cemented carbide useful particularly in oil and gas applications.

BACKGROUND

Choke valves are critical components in oil and gas production systems because of their relatively short life time. Moreover, the prediction of in-service performance and reliability is critical due to accessibility, e.g., subsea and expensive production downtime for service.

Choke valves may be subjected to high velocity (>200 m/s) flows which can be mixed sand/oil/gas/water of variable pH and can also feature 'sour' conditions including $H_2S$.

Tungsten carbide together with cobalt metal binder currently dominates the materials used for choke valves because of its unique combination of hardness, strength and wear resistant properties. However, under certain circumstances of oil and gas flow control there are detrimental properties of the hardmetal binder material mainly due to its low corrosion resistance to acidic media.

SUMMARY

It is an object of the present invention to provide a cemented carbide with improved properties for oil and gas applications subjected to extreme wear and corrosion conditions, particularly in cases of galvanic corrosion.

It is a further object of the present invention to provide a flow control device for oil and gas applications with improved service life.

It has been found that the above objective can be met by a cemented carbide composition comprising WC and, in wt-%, 3-11 Ni, 0.5-7 Cr, 0.3-1.5 Mo, 0-1 Nb, and 0-0.2 Co.

DETAILED DESCRIPTION

Under certain circumstances of oil and gas flow control there are there are detrimental properties of conventional hardmetal binder material, especially in conditions where galvanic potential prevails.

The corrosion process of hardmetal is to some extent controlled by many factors and it has been found that this includes galvanic coupling, i.e., when different metals are immersed in a corrosive solution each will develop a corrosion potential. This case can exist between the hardmetal choke and the steel body that supports it in a flow control system.

According to the invention the wear and corrosion resistance under such conditions is significantly improved for a cemented carbide comprising a hard phase comprising WC and a binder phase wherein the cemented carbide composition comprises WC and, in wt-%, 3-11 Ni, 0.5-7 Cr, 0.3-1.5 Mo, 0-1 Nb, and 0-0.2 Co.

In one embodiment, the cemented carbide composition comprises WC and, in wt-%, 5-7 Ni, 1.5-2.5 Cr, 0.5-1.5 Mo, 0-0.5 Nb, and 0-0.2 Co.

In one embodiment, the cemented carbide composition comprises WC and, in wt-%, 5-7 Ni, 1.5-2.5 Cr, 0.5-1.5 Mo, more than 0 and less than 0.5 Nb, and 0-0.2 Co.

In one embodiment, the cemented carbide composition comprises WC and, in wt-%, 5-7 Ni, 1.5-2.5 Cr, 0.5-1.5 Mo, 0-0.5 Nb, and more than 0 and less than 0.2 Co.

Suitably the WC content in the cemented carbide composition is 80-95 wt-%, preferably 85-95 wt-%.

It is further advantageous if the binder content in the cemented carbide is 5-20 wt-%, preferably 5-15 wt-%.

In one embodiment, the cemented carbide composition in addition comprises, in wt-%, 0-0.2 Si, 0-1 Fe, and 0-0.08 Mn.

In one embodiment, the cemented carbide composition in addition comprises, in wt-%, more than 0 and less than 0.2 Si, 0-1 Fe, and 0-0.08 Mn.

In one embodiment, the cemented carbide composition in addition comprises, in wt-%, 0-0.2 Si, more than 0 and less than 1 Fe, and 0-0.08 Mn.

In one embodiment, the cemented carbide composition in addition comprises, in wt-%, 0-0.2 Si, 0-1 Fe, and more than 0 and less than 0.08 Mn.

In one embodiment, the weight ratio Cr/Ni in the binder phase is 0.1-0.5.

In one embodiment, essentially all the hardphase WC grains in the sintered cemented carbide have a size below 1 μm, as measured using the linear intercept method.

In one embodiment, the cemented carbide composition comprises WC and, in wt-%, 3-11 Ni, 0.5-7 Cr, 0.3-1.5 Mo, 0-1 Nb, 0-0.2 Co, 0-0.2 Si, 0-1 Fe, 0-0.08 Mn, and wherein any other components any below 2 wt-%, suitably below 1 wt-%.

In one embodiment, the cemented carbide composition comprises WC and, in wt-%, 3-11 Ni, 0.5-7 Cr, 0.3-1.5 Mo, more than 0 and less than 1 Nb, 0-0.2 Co, 0-0.2 Si, 0-1 Fe, 0-0.08 Mn, and wherein any other components any below 2 wt-%, suitably below 1 wt-%.

In one embodiment, the cemented carbide composition comprises WC and, in wt-%, 3-11 Ni, 0.5-7 Cr, 0.3-1.5 Mo, 0-1 Nb, more than 0 and less than 0.2 Co, 0-0.2 Si, 0-1 Fe, 0-0.08 Mn, and wherein any other components any below 2 wt-%, suitably below 1 wt-%.

In one embodiment, the cemented carbide composition comprises WC and, in wt-%, 3-11 Ni, 0.5-7 Cr, 0.3-1.5 Mo, 0-1 Nb, 0-0.2 Co, more than 0 and less than 0.2 Si, 0-1 Fe, 0-0.08 Mn, and wherein any other components any below 2 wt-%, suitably below 1 wt-%.

In one embodiment, the cemented carbide composition comprises WC and, in wt-%, 3-11 Ni, 0.5-7 Cr, 0.3-1.5 Mo, 0-1 Nb, 0-0.2 Co, 0-0.2 Si, more than 0 and less than 1 Fe, 0-0.08 Mn, and wherein any other components any below 2 wt-%, suitably below 1 wt-%.

In one embodiment, the cemented carbide composition comprises WC and, in wt-%, 3-11 Ni, 0.5-7 Cr, 0.3-1.5 Mo, 0-1 Nb, 0-0.2 Co, 0-0.2 Si, 0-1 Fe, more than 0 and less than 0.08 Mn, and wherein any other components any below 2 wt-%, suitably below 1 wt-%.

In another embodiment, the cemented carbide composition comprises in wt-%, 86-93 WC, 5.8-6.6 Ni, 2.0-2.5 Cr, 0.7-1.2 Mo, 0.2-0.6 Nb, 0.02-0.07 Si, 0.05-0.15 Fe, and 0.02-0.07 Mn.

In another embodiment, the cemented carbide composition comprises in wt-%, 91-95 WC, 3.3-4.3 Ni, 1.0-1.5 Cr, 0.3-0.7 Mo, 0.1-0.4 Nb, 0.02-0.06 Si, 0.04-0.09 Fe, and 0.01-0.04 Mn.

In yet another embodiment, the cemented carbide composition comprises in wt-%, 86-93 WC, 9.0-10.0 Ni, 0.6-1.0 Cr, and 0.8-1.0 Mo.

In another embodiment, the cemented carbide composition comprises in wt-%, 91-95 WC, 3.3-4.3 Ni, 4.5-6.5 Cr, 0.4-0.9 Mo and 0.09-1.2 Si.

According to the invention there is also provided a method of making a cemented carbide as described above, comprising a hard phase comprising WC and a binder phase by using as raw material a WC powder and one or more further powders wherein the total composition of the one or more further powders is, in wt-%, 55-65 Ni, 15-25 Cr, 5-12 Mo, 0-6 Nb, and 0-1 Co.

In one embodiment, the total composition of the one or more further powders is, in wt-%, 55-65 Ni, 15-25 Cr, 5-12 Mo, more than 0 and less than 6 Nb, and 0-1 Co.

In one embodiment, the total composition of the one or more further powders is, in wt-%, 55-65 Ni, 15-25 Cr, 5-12 Mo, 0-6 Nb, and more than 0 and less than 1 Co.

In one embodiment, at least one of the further powders is a pre-alloyed metal based powder. In one exemplary embodiment of such a pre-alloyed powder the composition comprises, in wt-%, 55-65 Ni, 15-25 Cr, 5-12 Mo, 0-6 Nb, and 0-1 Co.

In another embodiment, at least of the further powders is in elemental or the element in its primary carbon compound, i.e., the powder consists of solely one element or the primary carbon compound, e.g., Ni, Cr ($Cr_3C_2$), Mo, Nb (NbC) or Co. In one exemplary embodiment, all of the further powders are elemental or a primary carbon compound. Minor normal impurities may also be present in the elemental powders.

The further powders may also include additional elements such as Si, Fe, Mn and C. Suitable amounts in the further powder when adding one or more of these additional elements are Si 0-0.6 wt-%; Fe 0-5 wt-%; Mn 0-0.6 wt %; C 0-0.15 wt-%.

In one embodiment, amounts in the further powder when adding one or more of these additional elements are more than 0 and less than 0.6 wt-% Si; 0-5 wt-% Fe; 0-0.6 wt % Mn; 0-0.15 wt-% C.

In one embodiment, amounts in the further powder when adding one or more of these additional elements are 0-0.6 wt-% Si; more than 0 and less than 0.5 wt-% Fe; 0-0.6 wt % Mn; 0-0.15 wt-% C.

In one embodiment, amounts in the further powder when adding one or more of these additional elements are 0-0.6 wt-% Si; 0-5 wt-% Fe; more than 0 and less than 0.6 wt-% Mn; 0-0.15 wt-% C.

In one embodiment, amounts in the further powder when adding one or more of these additional elements are 0-0.6 wt-% Si; 0-5 wt-% Fe; 0-0.6 wt % Mn; more than 0 and less than 15 wt-% C.

The cemented carbide used in the present invention is suitably prepared by mixing powders forming the hard constituents and powders forming the binder. The powders are suitably wet milled together, dried, pressed to bodies of desired shape and sintered. Sintering is suitably performed at temperatures between 1350 to 1500° C., suitably using vacuum sintering. Optionally, sintering can in part or completely be performed under a pressure, e.g., as a finishing sinterhip step at, e.g., 40-120 bar under for example Argon to obtain a dense cemented carbide.

In one embodiment, essentially the binder addition is made using a pre-alloyed material where powder grains have a size about 5 μm, meaning that suitably the grain size range 95% is between 1 and 10 μm particle distribution measured by laser diffraction techniques.

In one embodiment, the average WC powder grain size is by FSSS between 0.6 and 1.5 μm, suitably about 0.8 μm.

The wear resistance and appropriate corrosion resistance of the cemented carbide grade can thus be achieved by using a binder formulated from a 'stainless' alloy suitably matched to the steel body composition of a choke control system to minimise galvanic effects and to give superior corrosion resistance. Furthermore, by the combination of a WC with suitably submicron, preferably about 0.8 μm, grain size and pre-alloy binder a surprisingly high hardness, 1800-2100 Hv30, can be achieved, compared to a cemented carbide of similar binder content of cobalt with WC with submicron 0.8 μm grain size (1500-1700 Hv30).

According to the invention there is also provided a flow control device comprising a cemented carbide according to the invention. Exemplary flow control devices comprise, e.g., choke and control valve components, such as needles, seats, chokes, stems, sealing devices, liners etc.

The invention also relates to the use of a cemented carbide according to invention for oil and gas applications in a corrosive, abrasive and erosive environment.

The invention also relates to the use of a cemented carbide according to the invention in a flow control device.

EXAMPLE 1

Cemented carbide test coupons and valve bodies according to embodiments of the invention composition were produced according to known methods and tested against the previous prior art for flow control standard cemented carbide (Ref. E-G) according to Table 1 below.

The cemented carbide samples according to the invention were prepared from powders forming the hard constituents and powders forming the binder. The powders were wet milled together with lubricant and anti flocculating agent until a homogeneous mixture was obtained and granulated by spray drying. The dried powder was pressed to bodies of desired shape by isostatically 'wetbag' pressing and shaped in the green form before sintering. Sintering is performed at 1450° C. for about 1 hour in vacuum, followed by applying a high pressure, 50 bar Argon, at sintering temperature for about 30 minutes to obtain a dense structure before cooling The cemented carbide grades with the compositions in wt-% according to Table 1 were produced by mixing and milling WC powder with a FSSS grain size of 0.8 μm, and a powder forming the binder.

TABLE 1

(composition in wt-%)

| Ref | A | B | C | D | E | F | G |
|---|---|---|---|---|---|---|---|
| Sample | invention | invention | invention | invention | prior art | prior art | prior art |
| WC | Balance | Balance | Balance | Balance | Balance | Balance | Balance |
| WC grain | 0.8 | 0.8 | 0.8 | 0.8 | 0.8 | 0.8 | 4 |

TABLE 1-continued

| (composition in wt-%) | | | | | | | |
|---|---|---|---|---|---|---|---|
| size FSSS (μm) | | | | | | | |
| Binder (wt-%) | 10 | 6 | 10 | 10 | 5 | 10 | 9 |
| | as pre-alloy | as pre-alloy | elemental | as pre-alloy | elemental | elemental | elemental |
| Co | | | | | 3.3 | 10 | |
| Nb | 0.4 | 0.25 | | | | | |
| Cr | 2.2 | 1.32 | 0.8 | 5.5 | 0.52 | 0.4 | 0.7 |
| Ni | 6.3 | 3.8 | 9.63 | 3.8 | 1.1 | | 8 |
| Mo | 0.9 | 0.5 | 0.88 | 0.7 | 0.1 | | 0.28 |
| Si | 0.05 | 0.03 | | 0.1 | | | |
| Fe | 0.1 | 0.06 | | | | | |
| Mn | 0.04 | 0.02 | | | | | |

The sintered structure of the invented cemented carbide comprises WC with an average grain size of 0.8 μm, as measured using the linear intercept method and the material has a hardness range of 1600-2000 Hv30 depending on the selected composition.

Cemented carbide grade test coupons were abrasion and corrosion tested according to ASTM standards B611 and 61 (including acidic media).

Other properties have been measured according to the standards used in the cemented carbide field, i.e. ISO 3369:1975 for the density, ISO 3878:1983 for the hardness and ASTM G65 for the abrasion wear resistance.

The corrosion resistance has been characterized according to ASTM 61 standard particularly suited for measuring corrosion of (Co, Ni, Fe) in chloride solution.

The results are presented in the Table 2 below.

TABLE 2

| Ref | A | B | C | D | E | F | G |
|---|---|---|---|---|---|---|---|
| Sample | invention | invention | invention | invention | prior art | prior art | prior art |
| Density | 14.5 | 14.36 | 14.36 | 14.41 | 14.4 | 14.4 | 14.6 |
| Hardness (Hv30) | 1950 | 1880 | 1600 | 2000 | 1900 | 1600 | 1350 |
| Toughness (K1c) $MN/mm^{1.5}$ | 7.1 | 7.5 | 10.8 | | 9.5 | 13.0 | 13.0 |
| Porosity ISO4505 | A02 | A02 | A02 | A02 | A02 | A02 | A02 |
| | B00 | B00 | B00 | B00 | B00 | B00 | B00 |
| | C00 | C00 | C00 | C00 | C00 | C00 | C00 |
| | E04 | E04 | | E02 | | | |
| Corrosion resistance* | 10 | 10 | 9 | 9 | 6 | 2 | 8 |
| Wear resistance B611, Wear loss $mm^3$ | 10 | 25 | 65 | 6 | 20 | 65 | 100 |
| Performance lifetime | >×5 | ×5 | ×5 | ×5 | ×1 | ×1 | ×1 |

*Breakdown potential according to ASTM61 with flushed port cell
Eb ($10\mu A/cm^2$) normalised ranking scale 1-10 where Stainless steel 316 = 10
**Estimated service life before replacement to minimise risk of potential catastrophic failure.

Thus compared to prior art, Ref E-G, the invention exhibits improvements as shown below.

The corrosion resistance is increased by up to more than ×5.

The invention claimed is:

1. A cemented carbide composition for oil and gas applications comprising a hard phase and a binder phase, the cemented carbide composition comprising, in wt-%, 86.8-89.6 WC, 9.0-10.0 Ni, 0.6-1.0 Cr, 0.8-1.0 Mo, 0-1 Nb, and 0-0.2 Co.

2. The cemented carbide composition according to claim 1, further comprising WC and, in wt-%, more than 0 and less than 0.5 Nb.

3. The cemented carbide composition according to claim 1, further comprising, in wt-%, more than 0 and less than 0.2 Si, 0-1 Fe, and 0-0.08 Mn.

4. The cemented carbide composition according to claim 1, further comprising, in wt-%, 0-0.2 Si, more than 0 and less than 1 Fe, and 0-0.08 Mn.

5. The cemented carbide composition according to claim 1, further comprising, in wt-%, 0-0.2 Si, 0-1 Fe, and more than 0 and less than 0.08 Mn.

6. The cemented carbide composition according to claim 1, wherein the weight ratio Cr/Ni is 0.1-0.5.

7. The cemented carbide composition of claim 1, wherein the cemented carbide composition is a flow control device used in a corrosive, abrasive and erosive environment.

8. The cemented carbide composition according to claim 7, wherein the flow control device is a sealing device.

9. The cemented carbide composition of claim 1, further comprising WC and, in wt %, more than 0 and less than 0.6 Si, 0-5 Fe, 0-0.6 Mn, and 0-0.15 C.

10. The cemented carbide composition of claim 1, further comprising WC and, in wt %, 0-0.6 Si, more than 0 and less than 5 Fe, 0-0.6 Mn, and 0-0.15 C.

11. The cemented carbide composition of claim 1, further comprising WC and, in wt %, 0-0.6 Si, 0-5 Fe, more than 0 and less than 0.6 Mn, and 0-0.15 C.

12. The cemented carbide composition of claim 1, further comprising WC and, in wt %, 0-0.6 Si, 0-5 Fe, 0-0.6 Mn, and more than 0 and less than 0.15 C.

* * * * *